US008359699B2

(12) United States Patent
Tanaka

(10) Patent No.: US 8,359,699 B2
(45) Date of Patent: Jan. 29, 2013

(54) CLEANING TOOL AND CLEANING ELEMENT

(75) Inventor: Yoshinori Tanaka, Kanonji (JP)

(73) Assignee: Uni-Charm Corporation, Ehime (JP)

( * ) Notice: Subject to any disclaimer, the term of this patent is extended or adjusted under 35 U.S.C. 154(b) by 1343 days.

(21) Appl. No.: 12/042,540

(22) Filed: Mar. 5, 2008

(65) Prior Publication Data

US 2008/0216264 A1 Sep. 11, 2008

(30) Foreign Application Priority Data

Mar. 5, 2007 (JP) ..... 2007-054926

(51) Int. Cl.
*A47L 13/20* (2006.01)
*A47L 13/38* (2006.01)

(52) U.S. Cl. ..... 15/229.3; 15/226; 15/229.4

(58) Field of Classification Search ..... 15/209.1, 15/226, 227, 229.1, 229.3, 229.7, 229.4
See application file for complete search history.

(56) References Cited

U.S. PATENT DOCUMENTS

| | | | | |
|---|---|---|---|---|
| 3,495,918 | A | 2/1970 | Leland | |
| 6,813,801 | B2 * | 11/2004 | Tanaka et al. | 15/229.3 |
| 7,712,178 | B2 * | 5/2010 | Yamada | 15/230 |
| 2005/0241088 | A1 | 11/2005 | Brunner et al. | |
| 2006/0185108 | A1 | 8/2006 | Hoadley et al. | |

FOREIGN PATENT DOCUMENTS

| | | | |
|---|---|---|---|
| EP | 1 676 519 | A1 | 7/2006 |
| EP | 1 731076 | A1 | 12/2006 |
| JP | 09-154791 | A | 6/1997 |

OTHER PUBLICATIONS

Mexican Office Action and English translation from corresponding Mexican Application No. MX/A/2008/003121 dated Apr. 20, 2011.
European Search Report from corresponding European Application No. 08152335.9 dated Dec. 28, 2011 (8 pgs).
Mexican 2nd Office Action and English translation from corresponding Mexican Application No. MX/A/2008/003121 dated Nov. 23, 2011.

* cited by examiner

*Primary Examiner* — Randall Chin
(74) *Attorney, Agent, or Firm* — Brinks Hofer Gilson & Lione

(57) ABSTRACT

A cleaning tool and an effective technique for realizing a higher cleaning effect in a cleaning tool having a cleaning element for wiping a region to be cleaned is provided. The cleaning tool includes an elongate cleaning element holder and a cleaning element to be attached to the cleaning element holder. The cleaning element holder includes a grip to be held by a user and two holding elements connected to the grip and extending parallel in a longitudinal direction with a predetermined spacing therebetween. The cleaning element includes a sheet element of nonwoven fabric, at least three insert regions demarcated by the sheet element and extending parallel to each other, and a covering part that covers the sheet element and forms a wiping face. The two holding elements extending with the predetermined spacing are inserted into arbitrarily selected two of the at least three insert regions.

3 Claims, 10 Drawing Sheets

CLEANING TOOL AND CLEANING ELEMENT

CROSS-REFERENCE TO RELATED APPLICATION

The present application claims priority under 35 U.S.C. §119 to Japanese Patent Application No. 2007-054926 filed on Mar. 5, 2007. The content of the application is incorporated herein by reference in its entirety.

BACKGROUND OF THE INVENTION

1. Field of the Invention

The present invention relates to a cleaning tool, and more particularly to a cleaning tool having a cleaning element for wiping a region to be cleaned.

2. Description of the Related Art

Various types of cleaning tools are known with a sheet-type cleaning element for wiping a region to be cleaned. For example, Japanese non-examined laid-open Patent Publication No. 9-154791 discloses a cleaning tool having cleaning fabric and a holder that detachably holds the cleaning fabric inserted into a holding region of the cleaning fabric. This cleaning tool is capable of wiping a region to be cleaned by using the cleaning fabric held via the holder. However, in designing a cleaning tool of this type having a cleaning element, it is required to provide an effective technique for enhancing its cleaning effect.

SUMMARY OF THE INVENTION

Accordingly, it is an object of the invention to provide an effective technique for realizing a higher cleaning effect in a cleaning tool having a cleaning element for wiping a region to be cleaned.

The above-described object can be achieved by the features of the claimed invention. A cleaning tool according to an embodiment of this invention is used for wiping a region to be cleaned and includes at least a cleaning element holder and a cleaning element. The cleaning element holder is an elongate member. The cleaning element holder includes a grip to be held by a user and two holding elements connected to the grip and extending parallel in a longitudinal direction with a predetermined spacing therebetween. In this case, the two holding elements extend parallel substantially in the same direction. The cleaning element is designed to be attached to the elongate cleaning element holder. The cleaning element includes at least three insert regions demarcated by a sheet element of nonwoven fabric and extending parallel to each other, and a covering part that covers the sheet element and forms a wiping face. In this case, the at least three insert regions extend parallel substantially in the same direction. The cleaning tool is formed by inserting the two holding elements extending with the predetermined spacing into arbitrarily selected two of the at least three insert regions.

With such a construction of the cleaning tool, the two holding elements can be reinserted into different combinations of two of the insert regions as necessary, so that relative placement of the covering part around the holding elements can be changed. Thus, the entire outer surface of the covering part can be evenly used as a cleaning face, so that the inherent cleaning ability of the cleaning element can be fully utilized. Therefore, the cleaning tool having a higher cleaning effect can be provided. Further, one cleaning element can be used for a longer period of time, so that it is more economical.

In a further embodiment of the cleaning tool according to this invention, preferably, the sheet element comprises a base sheet and a holding sheet which are formed of nonwoven fabric. The base sheet and the holding sheet are overlaid one on the other and bonded together in such a manner as to define the at least three insert regions. Further, the covering part includes the holding sheet positioned on the internal side of the cleaning element and the base sheet positioned on the external side of the cleaning element and further includes a fiber assembly comprising a plurality of fibers extending in a predetermined direction. The fiber assembly is bonded to the base sheet in such a manner as to cover the base sheet. With such a construction, the two holding elements can be reinserted into different combinations of two of the insert regions as necessary, so that the entire outer surface of the fiber assembly can be evenly used as a cleaning face.

A cleaning element according to an embodiment of this invention is used for wiping a region to be cleaned and includes at least three insert regions demarcated by a sheet element of nonwoven fabric and extending parallel in a longitudinal direction and a covering part that covers the sheet element and forms a wiping face.

With such a construction, when the cleaning element is attached to the cleaning element holder having two holding elements, the two holding elements can be reinserted into different combinations of two of the insert regions as necessary, so that relative placement of the covering part around the holding elements can be changed. Thus, the entire outer surface of the covering part can be evenly used as a cleaning face, so that the inherent cleaning ability of the cleaning element can be fully utilized. Therefore, one cleaning element can be used for a longer period of time, so that it is more economical. Further, in the construction in which the distance between the insert regions can be changed by combination of two of the insert regions, each time the two holding elements are inserted into arbitrarily selected two of the insert regions, the sectional shape of the cleaning tool in the direction crossing the extending direction of the cleaning element holder can be changed into various shapes, such as circular, flat or uneven shape.

In a further embodiment of the cleaning element according to this invention, the sheet element includes a base sheet and a holding sheet which are formed of nonwoven fabric, and the base sheet and the holding sheet are overlaid one on the other and bonded together in such a manner as to define the at least three insert regions. Further, the covering part includes the holding sheet positioned on the internal side of the cleaning element and the base sheet positioned on the external side of the cleaning element and further includes a fiber assembly comprising a plurality of fibers extending in a predetermined direction. The fiber assembly is bonded to the base sheet in such a manner as to cover the base sheet. With such a construction, the two holding elements can be reinserted into different combinations of two of the insert regions as necessary, so that the entire outer surface of the fiber assembly can be evenly used as a cleaning face.

In the cleaning element according to an embodiment of this invention, the sheet element of nonwoven fabric may comprise a single nonwoven fabric sheet layer or a plurality of nonwoven fabric sheet layers having the same or different functions and stacked in layer. The "nonwoven fabric" herein has a sheet-like configuration formed by fixing or entangling fibers by mechanical, chemical or heat treatment. Typically, the nonwoven fabric partly includes thermal melting fibers (thermoplastic fibers) and thus can be fusion bonded. Further, preferably, the fiber assembly having a plurality of fibers extending in a predetermined direction may have a planar structure having a predetermined flat or curved surface and have a three-dimensional form having a certain thickness or a thin sheet-like form. The "fibers" herein are elements of yarn, textile or the like and defined as being thin and flexible fibers having a substantially longer length compared with the thickness. Typically, a long continuous fiber is defined as a filament and a short fiber as a staple. Further, the "fiber assembly" herein is a single fiber structure formed by the above-mentioned fibers, a fiber structure having the above-mentioned fibers aligned in the length direction and/or the radial direction (twist yarn, spun yarn, yarn to which a plurality of filaments are partially connected), or an assembly of the fiber structures. Typically, the fiber assembly is formed of polyethylene (PE), polypropylene (PP), polyethylene terephthalate (PET), nylon, rayon or the like. In practical use, an assembly of filaments formed by opening a tow is frequently used as the fiber assembly.

Further, the cleaning element may be of disposable type designed for single use, disposable type designed for multiple use which can be used several times, while holding dust which has been removed from the region to be cleaned, on a brush portion, or reusable type which can be reused by washing.

As described above, in a cleaning tool having a cleaning element for wiping a region to be cleaned, particularly by provision of the construction in which at least three insert regions are provided in the cleaning element and two holding elements of the cleaning element holder which extend parallel in a longitudinal direction with a predetermined spacing can be inserted into arbitrarily selected two of the at least three insert regions, the entire outer surface of the covering part can be evenly used as a cleaning face, so that the cleaning tool having a higher cleaning effect can be provided.

Other objects, features and advantages of the present invention will be readily understood after reading the following detailed description together with the accompanying drawings and the claims.

DETAILED DESCRIPTION OF THE INVENTION

Each of the additional features and method steps disclosed above and below may be utilized separately or in conjunction with other features and method steps to provide improved cleaning tools and method for using such cleaning tools and devices utilized therein. Representative examples of the invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

A representative embodiment of the present invention is now be described with reference to the drawings. First, the structure of a cleaning tool 100 according to this embodiment is explained with reference to FIGS. 1 to 4. Objects to be cleaned with the cleaning tool 100 includes regions to be cleaned (floors, walls, windows, ceilings, external walls, furniture, clothes, curtains, bedding, lighting, home electric appliances, etc.) inside and outside of houses, apartments, buildings, factories, vehicles, etc. and regions of human body parts to be cleaned. These regions to be cleaned may be either flat or curved, uneven or stepped.

Figure 1:
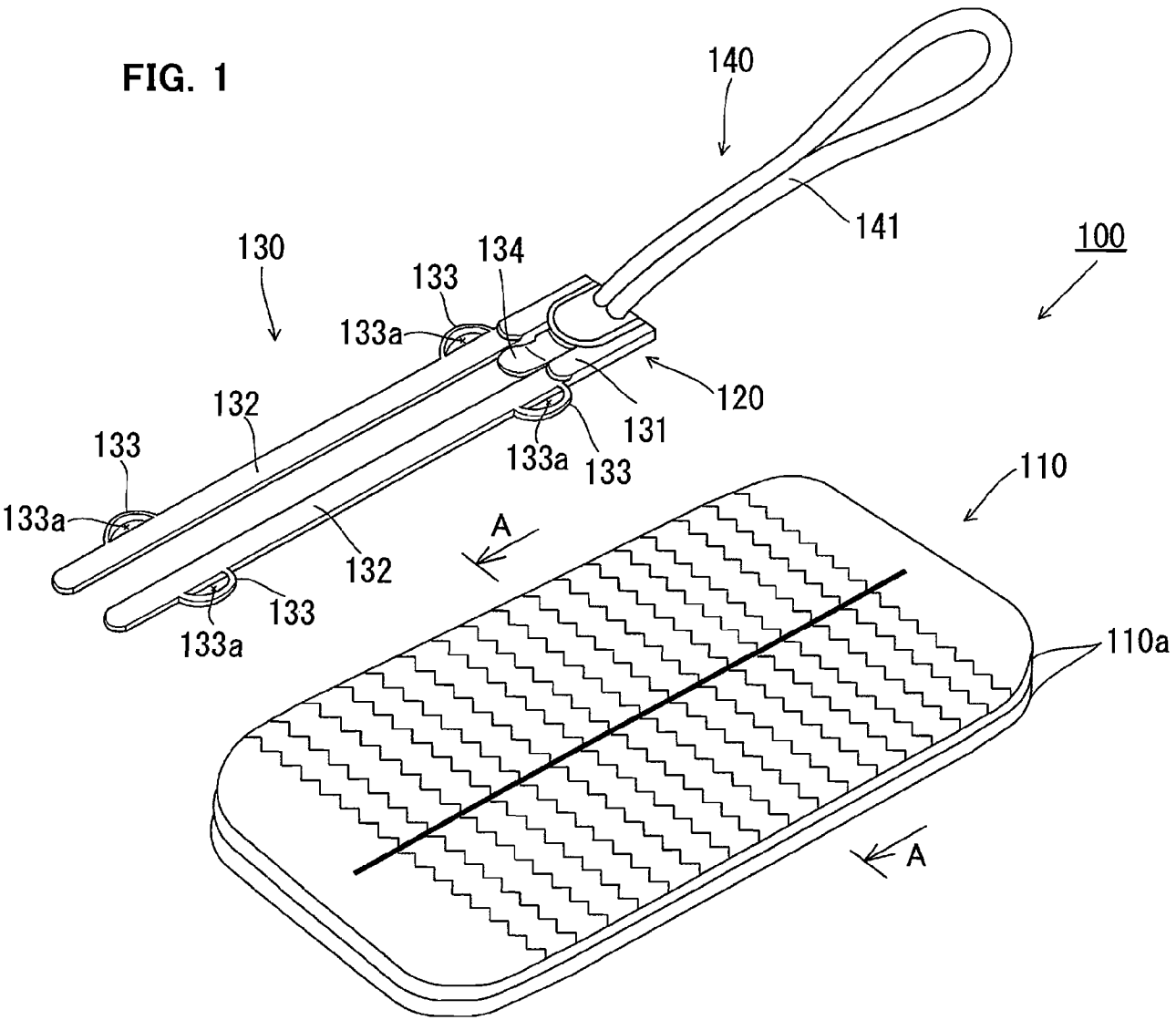
FIG. 1 is a perspective view showing a cleaning tool 100 according to an embodiment of the present invention, in a disassembled state into a cleaning element 110 and a cleaning element holder 120.

FIG. 1 shows the cleaning tool 100 according to this embodiment in perspective view, in a state disassembled into a cleaning element 110 and a cleaning element holder 120. As shown in FIG. 1, the cleaning tool 100 comprises the cleaning element 110 and the cleaning element holder 120.

The cleaning element 110 has a function of removing dirt on the region to be cleaned. The cleaning element 110 is available in a sheet-like form, and in use, it is loosened such that its volume is increased. As shown in FIG. 1, the cleaning element 110 is formed by sheet-type layered parts 110*a* overlaid one on the other and bonded together and has a rectangular shape in plan view, extending in a predetermined longitudinal direction (the direction of the length), which will be explained in more detail below. The cleaning element 110 is a feature that corresponds to the "cleaning element" according to an embodiment of this invention. The cleaning element 110 may also have a square or other shape in plan view as necessary.

The cleaning element holder 120 is removably attached to the cleaning element 110. The cleaning element holder 120 is an elongate member including the holder body 130 and the handle 140 connected to each other. The cleaning element holder 120 is a feature that corresponds to the "cleaning element holder" according to an embodiment of this invention. The handle 140 includes a handle body 141 extending in an elongate form and a connection 141*a* disposed between the handle body 141 and the holder body 130. The handle body 141 is a portion to be held by a user. The handle body 141 and the holder body 130 are fixedly connected at the connection 141*a*. The handle 140 and the handle body 141 here form the "grip" according to an embodiment of this invention.

The holder body 130 has a function of detachably holding the cleaning element 110. The holder body 130 includes a pair of right and left holding plates 132 and a retaining plate 134 which are formed on a base 131 of the handle 140. The holding plates 132 extend forward in the longitudinal direction from the base 131 and parallel with a predetermined spacing therebetween on the same plane. In other words, the holder body 130 has a bifurcated form. Each of the holding plates 132 has a constant width in the longitudinal direction or is tapered. The holding plates 132 here form the "two holding elements" according to an embodiment of this invention. The holding plates 132 may also have a circular or polygonal section forming a rod-like shape.

Further, two projections 133 are formed on the front and rear portions of the outer edge of each of the holding plates 132. Each of the projections 133 has an elliptic contour projecting outward from the holding plate 132 and has a convexly curved projecting surface. Further, an opening or hollow portion 133*a* is formed in the central portion of the projection 133. The retaining plate 134 extends forward between the pair holding plates 132 and is convexly curved downward. The retaining plate 134 further has an engagement lug (not shown) on the underside.

Each of the holding plates 132 can be inserted into an insert region (an insert region 116 which is described below) and have a function of holding the cleaning element 110 in the inserted state. In the inserted state, each of the holding plates 132 is fitted in the insert region by close sliding contact, so that the cleaning element 110 is securely attached to the holding plate 132. Further, in the inserted state, the retaining plate 134 presses the cleaning element 110 from above, and the engagement lug (not shown) formed on the underside of the retaining plate 134 serves as a stopper for preventing the cleaning element 110 from coming off. Thus, in the inserted state in which the holding plates 132 are inserted into the insert region of the cleaning element 110, the cleaning element 110 is reliably retained by the holder body 130.

Figure 2:
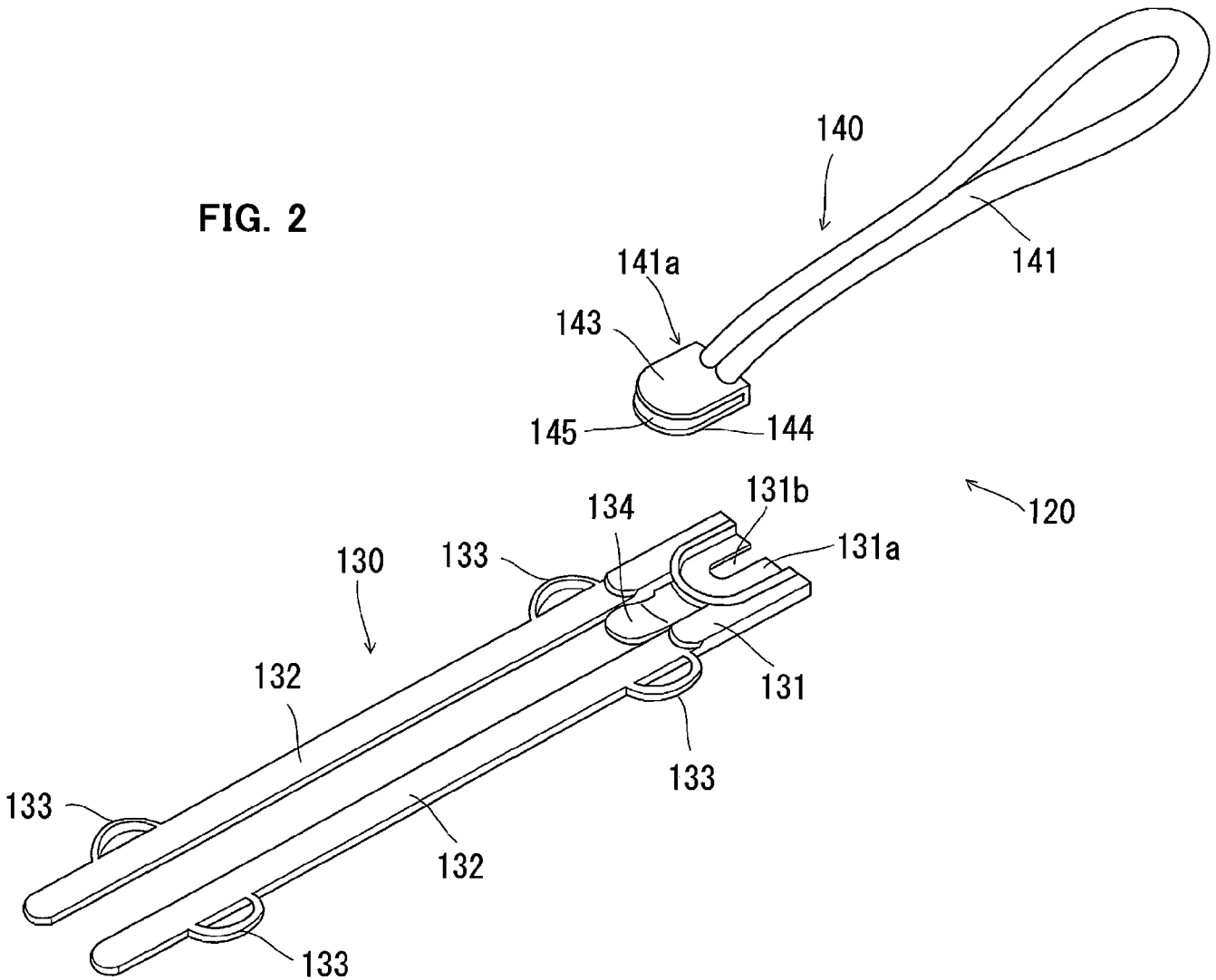
FIG. 2 is a perspective view of the cleaning element holder 120 of FIG. 1 in a disassembled state.

FIG. 2 is a perspective view of the cleaning element holder 120 of FIG. 1 in a disassembled state. As shown, the holder body 130 and the handle 140 are separately resin molded and thereafter disengageably connected together. The holder body 130 has an engagement plate 131*a* on the rear end of the base 131. The handle 140 has a first engaging plate 143 and a second engaging plate 144 on the front end of the handle body 141. An engagement region 145 is defined between the first engaging plate 143 and the second engaging plate 144 and can receive the engagement plate 131*a*. A projection (not shown) is provided in the engagement region 145 and can be engaged with a recess 131*b* of the engagement plate 131*a*.

Thus, when the engagement plate 131*a* is inserted into the engagement region 145, the engagement plate 131*a* is sandwiched between the first engaging plate 143 and the second engaging plate 144. Further, the projection of the engagement region 145 is engaged with the recess 131*b* of the engagement plate 131*a*. Thus, the holder body 130 and the handle 140 are joined together by a joining force acting therebetween. In this state, the holder body 130 and the handle 140 can be disengaged from each other by pulling the holder body 130 and the handle 140 apart from each other by a pulling force larger than the joining force. The cleaning element holder 120 may have other structures, such as a structure in which the holder body 130 and the handle 140 (the handle body 141 and the connection 141*a*) are integrally formed, a structure in which two of the holder body 130, the handle 140 and the connection 141*a* are integrally formed, and a structure in which the holder body 130 and the handle 140 are separately formed and designed to be fixedly connected together.

Figure 3:
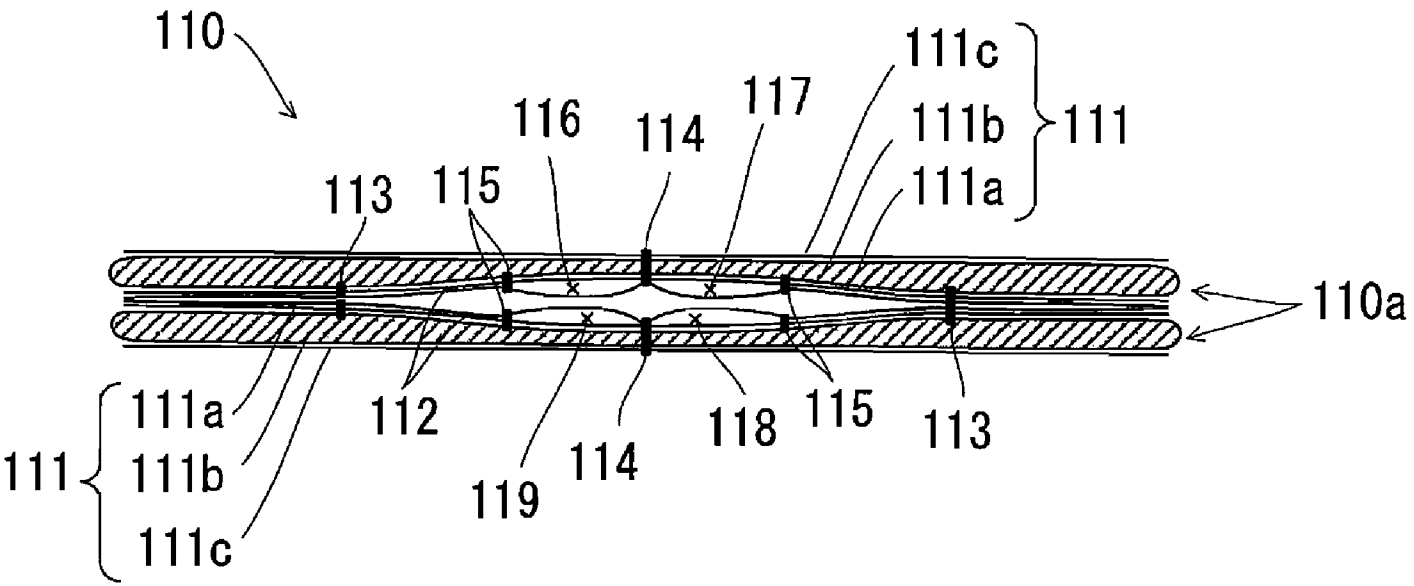
FIG. 3 is a sectional view of the cleaning element 110, taken along line A-A in FIG. 1.
Figure 4:
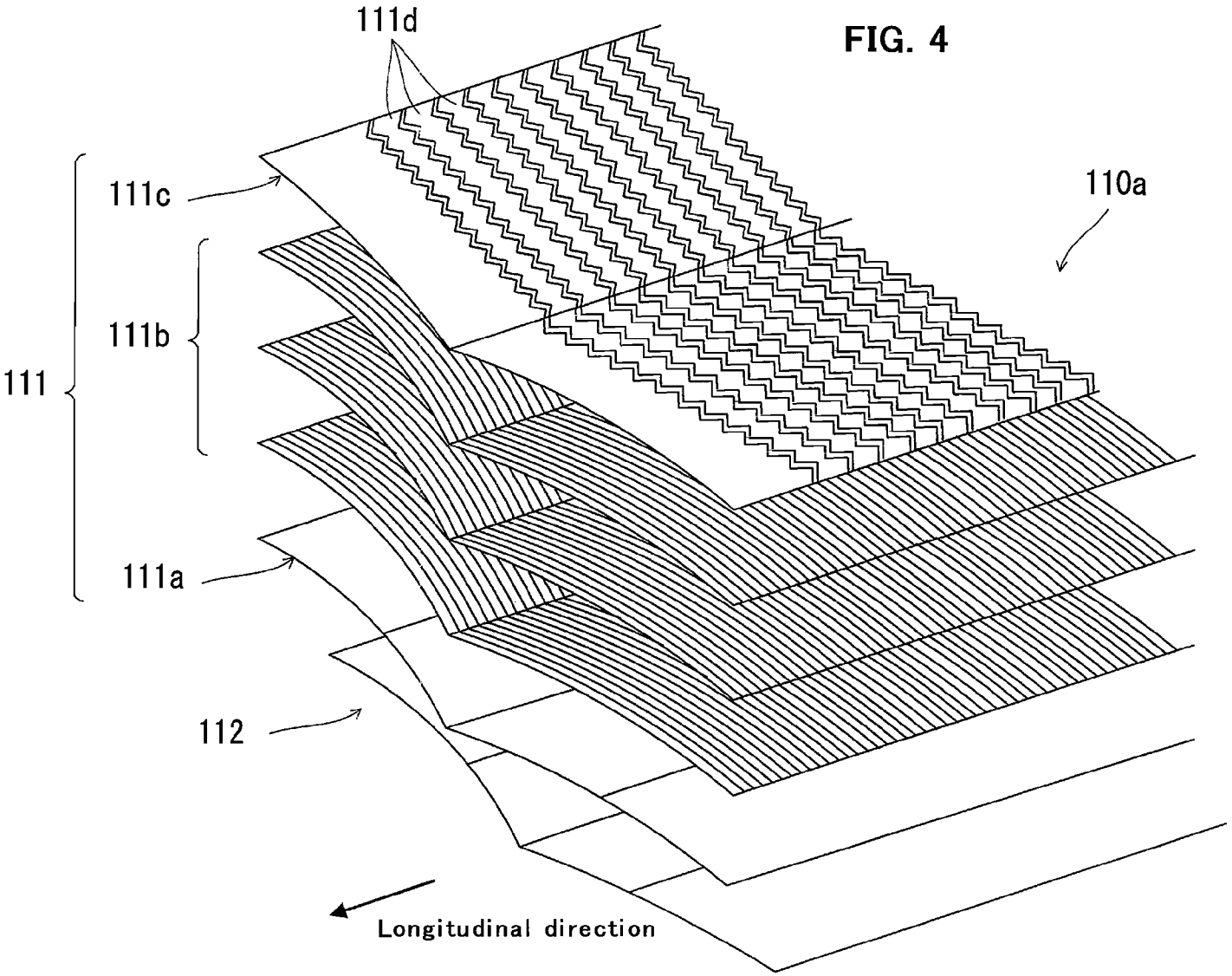
FIG. 4 is a perspective view of the cleaning element 110 of FIG. 1 which is shown separated into component elements.

Referring to FIGS. 3 and 4, the structure of the cleaning element 110 is specifically described. FIG. 3 is a sectional view of the cleaning element 110, taken along line A-A in FIG. 1, and FIG. 4 is a perspective view of the layered part 110*a* of the cleaning element 110 which is shown separated into component elements.

As shown in FIG. 3, the cleaning element 110 of this embodiment is formed by two layered parts 110*a* overlaid one on the other and fusion bonded together at a fusion bonded part 113. Each of the layered parts 110*a* has a layered part body 111 and a holding sheet 112 overlaid one on the other in this order from the cleaning side and fusion bonded together at the fusion bonded part 114. Further, the layered part body 111 has a front sheet 111*c*, a fiber assembly 111*b* and a base sheet 111*a* overlaid one on the other in this order from the cleaning side. In this case, the holding sheet 112 and the base sheet 111*a* are overlaid on the side of the fiber assembly 111*b* opposite the front sheet 111*c* and form a sheet element. A covering portion is formed by the two layered parts 110*a* such that the holding sheet 112 is positioned on the internal side of the cleaning element so as to define inner surfaces of the insert regions and the base sheet 111*a* is positioned externally of the holding sheet 112 with respect to the insert regions, and further such that the fiber assembly 111*b* is fusion bonded to the base sheet 111*a* in such a manner as to cover the base sheet 111*a*. The covering portion is a feature that corresponds to the "covering part" according to an embodiment of this invention.

Further, in each of the layered parts 110*a*, the holding sheet 112 and the base sheet 111*a* are fusion bonded at right and left two fusion bonded parts 115, so that a pair of right and left insert regions are created on both sides of the fusion bonded part 114. Therefore, in the layered state of the two layered parts, four insert regions 116, 117, 118, 119 extending parallel in the longitudinal direction inside the cleaning element 110 are created. The four insert regions 116, 117, 118, 119 are demarcated by the holding sheet 112, the base sheet 111*a* and the fusion bonded parts 114, 115 of each of the layered parts 110*a*. These four insert regions are shaped to have adequate size (insertion width and insertion depth) to receive the holding plates 132 of the holder body 130. The four insert regions 116, 117, 118, 119 are the features that correspond to the "at least three insert regions" according to an embodiment of this invention.

FIG. 4 is referred to as to the specific structure of each of the layered parts 110. As shown, each of the layered parts 110*a* has the layered part body 111 and the holding sheet 112 overlaid one on the other in this order from the outer surface of the cleaning element. Further, the layered part body 111 has the front sheet 111*c*, the fiber assembly 111*b* and the base sheet 111*a* overlaid one on the other in this order from the outer surface of the cleaning element. In this case, the holding sheet 112 and the base sheet 111*a* are overlaid on the side of the fiber assembly 111*b* opposite the front sheet 111*c*.

The base sheet 111*a*, the fiber assembly 111*b* and the front sheet 111*c* which form the layered part body 111 have the same rectangular sheet-like form in plan view and extend in a longitudinal direction of the cleaning element 110. The fiber assembly 111*b* and the front sheet 111*c* form a brush-like part having a dirt removing function, which is also referred to as the "brush portion". The cleaning element 110 may be of disposable type designed for single use, disposable type designed for multiple use which can be used several times, while holding dust which has been removed from the region to be cleaned, on the brush portion, or reusable type which can be reused by washing. Further, in this embodiment, the cleaning element body 111 of the cleaning element 110 is described as a structure having the base sheet 111*a*, the fiber assembly 111*b* and the front sheet 111*c* stacked in layer, but may be constructed as a structure having an additional fiber layer and/or sheet.

The front sheet 111*c* has a plurality of zigzag strips 111*d* (strip portions) extending in a direction crossing the longitudinal direction of the cleaning element 110. Specifically, the front sheet 111*c* has a plurality of strips 111*e* arranged in parallel and extending in a direction crossing the longitudinal direction of the cleaning element 110. An improved structure which can easily trap dust and thus has a higher cleaning function can be realized by the zigzag strips of the sheets. The strips may have the same kind or different kinds of shape appropriately selected from various shapes, such as zigzag, linear and curved shapes.

The construction of the nonwoven fabric forming the above-described base sheet 111*a*, front sheet 111*c* and holding sheet 112 and the construction of the fiber assembly 111*b* are now explained in detail.

The base sheet 111*a*, the front sheet 111*c* and the holding sheet 112 can typically be formed of sheet-type nonwoven fabric comprising thermal melting fibers (thermoplastic fibers) and thus referred to as nonwoven fabric sheet. The base sheet 111*a* and the holding sheet 112 herein form the "sheet element of nonwoven fabric" according to an embodiment of this invention. The nonwoven fabric has a sheet-like configuration formed by fixing or entangling fibers by mechanical, chemical or heat treatment. The nonwoven fabric partly includes thermoplastic fibers and thus can be fusion bonded. Further, the nonwoven fabric has a plurality of strips. Examples of the thermal melting fibers (thermoplastic fibers) include polyethylene, polypropylene and polyethylene terephthalate. The nonwoven fabric may be manufactured by through-air bonding, spun bonding, thermal bonding, spun lacing, point bonding, melt blowing, stitch bonding, chemical bonding, needle punching or other similar processes. This nonwoven fabric is a feature that corresponds to the "nonwoven fabric" according to an embodiment of this invention. In order to enhance the dust wiping function, it is preferred to use a nonwoven fabric having higher rigidity. Further, as an alternative to or in addition to the nonwoven fabric, a material to be worked into strips, such as urethane, sponge, woven fabric, net and split cloth, may be used.

The fiber assembly 111*b* is a single fiber structure formed by fibers, a fiber structure having fibers aligned in the length direction and/or the radial direction (twist yarn, spun yarn, yarn to which a plurality of filaments are partially connected), or an assembly of the fiber structures. The fiber assembly 111*b* partially includes thermoplastic fibers and can be fusion bonded. The fibers forming the fiber assembly 111*b* are elements of yarn, textile or the like and defined as being thin and flexible fibers having a substantially longer length compared with the thickness. Typically, a long continuous fiber is defined as a filament and a short fiber as a staple. The proximal ends of the fibers of the fiber assembly 111*b* are bonded at the fusion bonded parts 114 and 115. The fibers of the fiber assembly 111*b* each have one end fixed at the fusion bonded parts and the other free end (distal end) on the opposite side. The fibers of the fiber assembly 111*b* extend in a direction crossing the longitudinal direction of the cleaning element 110 (or the fiber assembly 111*b*). The fiber assembly 111*b* extending in a direction crossing the longitudinal direction of the cleaning element 110 is a feature that corresponds to the "fiber assembly comprising a plurality of fibers extending in a predetermined direction" according to this embodiment. The fiber assembly 111*b* is also referred to as the "fiber bundle" having a plurality of fibers in a bundle.

In the representative example shown in FIG. 2, the fiber assembly 111*b* comprises three fiber layers, but it may comprise one or more fiber layers as necessary. Preferably, the fiber assembly 111*b* has a planar structure having a predetermined flat or curved region and has a three-dimensional form having a certain thickness or has a thin sheet-like form. The "fiber assembly" is typically formed of polyethylene (PE), polypropylene (PP), polyethylene terephthalate (PET), nylon, rayon or the like. In practical use, an assembly of filaments formed by opening a tow is frequently used as the fiber assembly. It is particularly preferable that the fiber assembly comprises conjugated fibers having a core of polypropylene (PP) or polyethylene (PE) and a core covering sheath of polyethylene (PE). Further, the filaments of the fiber assembly are preferred to have a fineness of 1 to 50 dtex, more preferably 2 to 10 dtex. The individual fiber assembly may contain fibers of substantially the same fineness or of different finenesses.

Further, in order to enhance the dust wiping function, it is preferred to use a fiber assembly including fibers having higher rigidity or fibers having higher fineness. It is further preferred that the fiber assembly has crimped fibers. Here, the crimped fibers are fibers subjected to a predetermined crimping process and easily entangled with each other. With the fibers being crimped, the fiber assembly becomes bulkier than before the holder is attached thereto, and dust can be easily captured by the crimped portions. This structure can be realized especially by using crimped fibers opened from a tow.

For the fiber assembly, flat yarns or split yarns may also be employed. The flat yarns are prepared by slitting a film into tapes and by stretching the tapes in the longitudinal direction. The split yarns are prepared by splitting a thermoplastic film resin in the direction perpendicular to the orientation direction of the resin so that the film is fibrillated and interconnected into a net shape. Alternatively, a nonwoven fabric which is bulky and has low fiber density, such as a through-air bonded nonwoven fabric, may be employed to form the fiber assembly.

The kinds and numbers of the component parts of the cleaning element 110 are not limited to those described in the above-described example, and can be selected as necessary.

FIGS. 5 to 10 are referred to as to operation of the cleaning tool 100 having the above-described construction. FIGS. 5 to 10 schematically show the state in which the holding plates 132 are attached to the cleaning element 110 in this embodiment.

In using the cleaning tool 100 to wipe a region to be cleaned, in order to attach the cleaning element 110 and the cleaning element holder 120 to each other, first, the holding plates 132 of the cleaning element holder 120 are inserted into any insert regions of the cleaning element 110. Thus, the cleaning element 110 and the cleaning element holder 120 are attached to each other. At this time, preferably, in order to enhance the cleaning effect, the cleaning element 110 is fluffed as necessary so that the volume of the cleaning element 110 is increased.

In this embodiment, the four insert regions 116, 117, 118, 119 are provided inside the cleaning element 110, so that the two holding plates 132 extending with a predetermined spacing therebetween can be inserted into arbitrarily selected two of the insert regions 116, 117, 118, 119. Therefore, there are six possible manners of inserting the holding plates 132 as shown in FIGS. 5 to 10.

Figure 5:
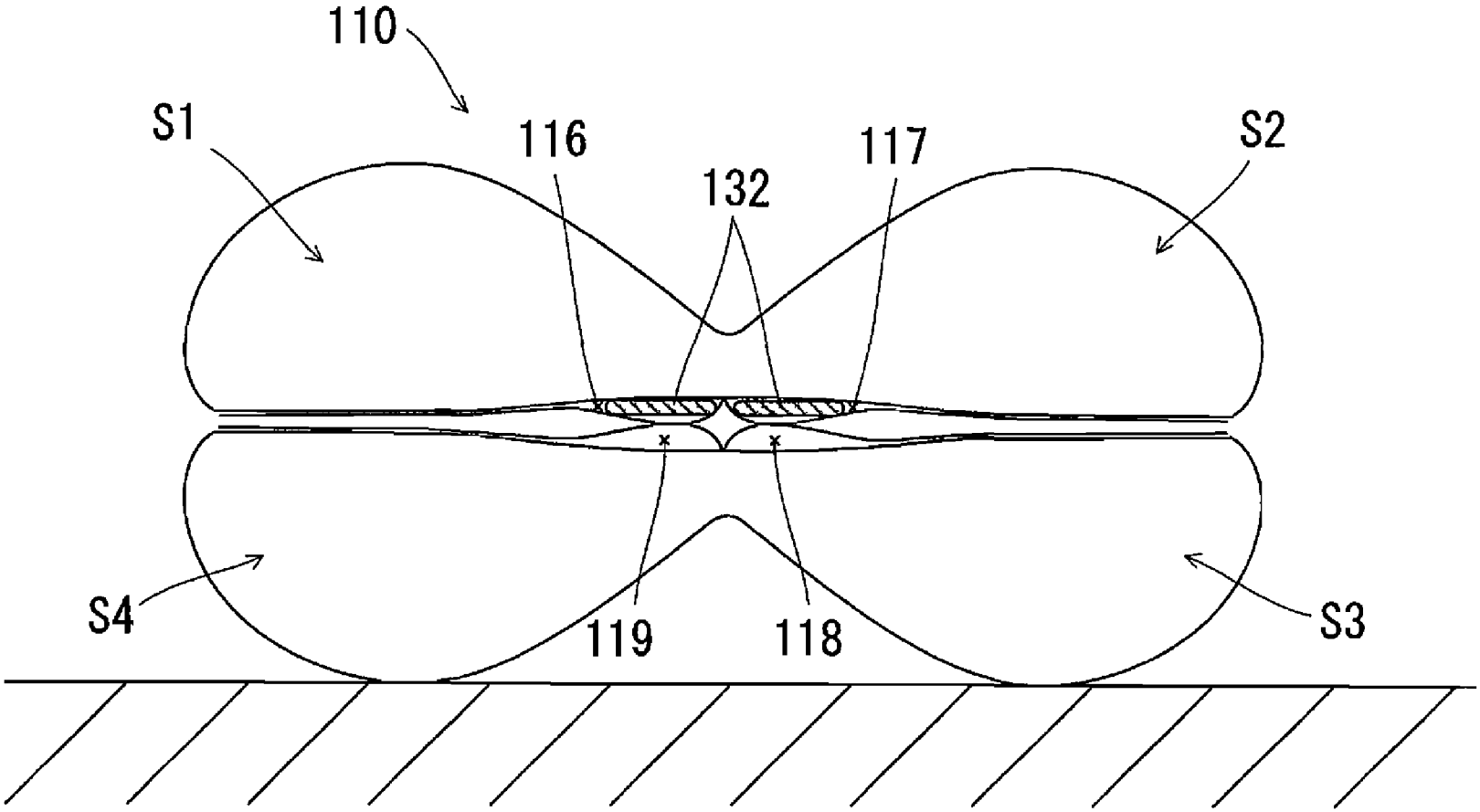
FIG. 5 is a schematic view showing the state in which the holding plates 132 are attached to the cleaning element 110 in this embodiment.

In the first manner shown in FIG. 5, the holding plates 132 are inserted into the insert regions 116, 117 of the cleaning element 110, so that cleaning faces S1, S2 are placed on the upper face side of the cleaning element 110, while cleaning faces S3, S4 are placed on the lower face side of the cleaning element 110.

Figure 6:
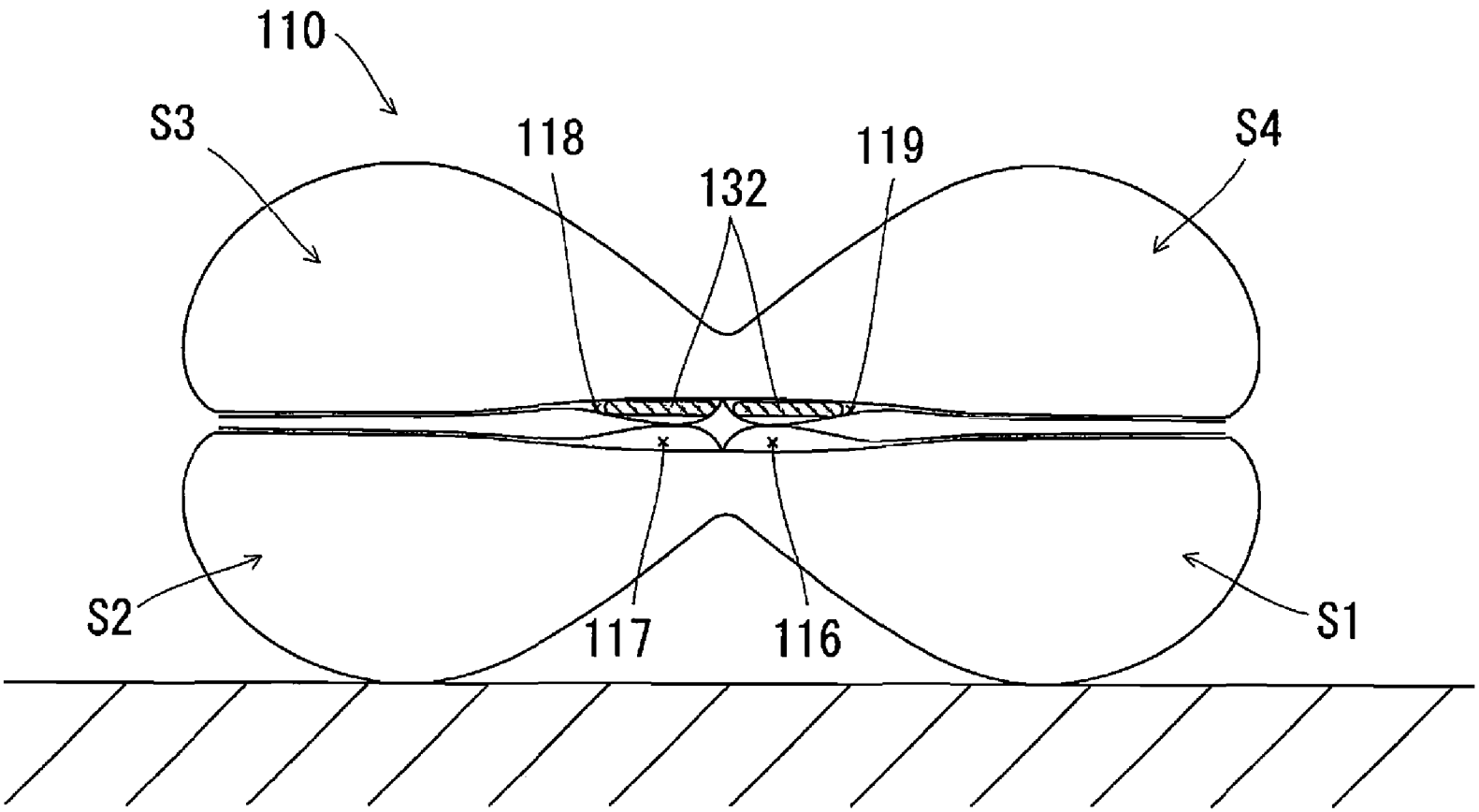
FIG. 6 is a schematic view showing the state in which the holding plates 132 are attached to the cleaning element 110 in this embodiment.

In the second manner shown in FIG. 6, the holding plates 132 are inserted into the insert regions 118, 119 of the cleaning element 110, so that the cleaning faces S3, S4 are placed on the upper face side of the cleaning element 110, while the cleaning faces S1, S2 are placed on the lower face side of the cleaning element 110.

Figure 7:
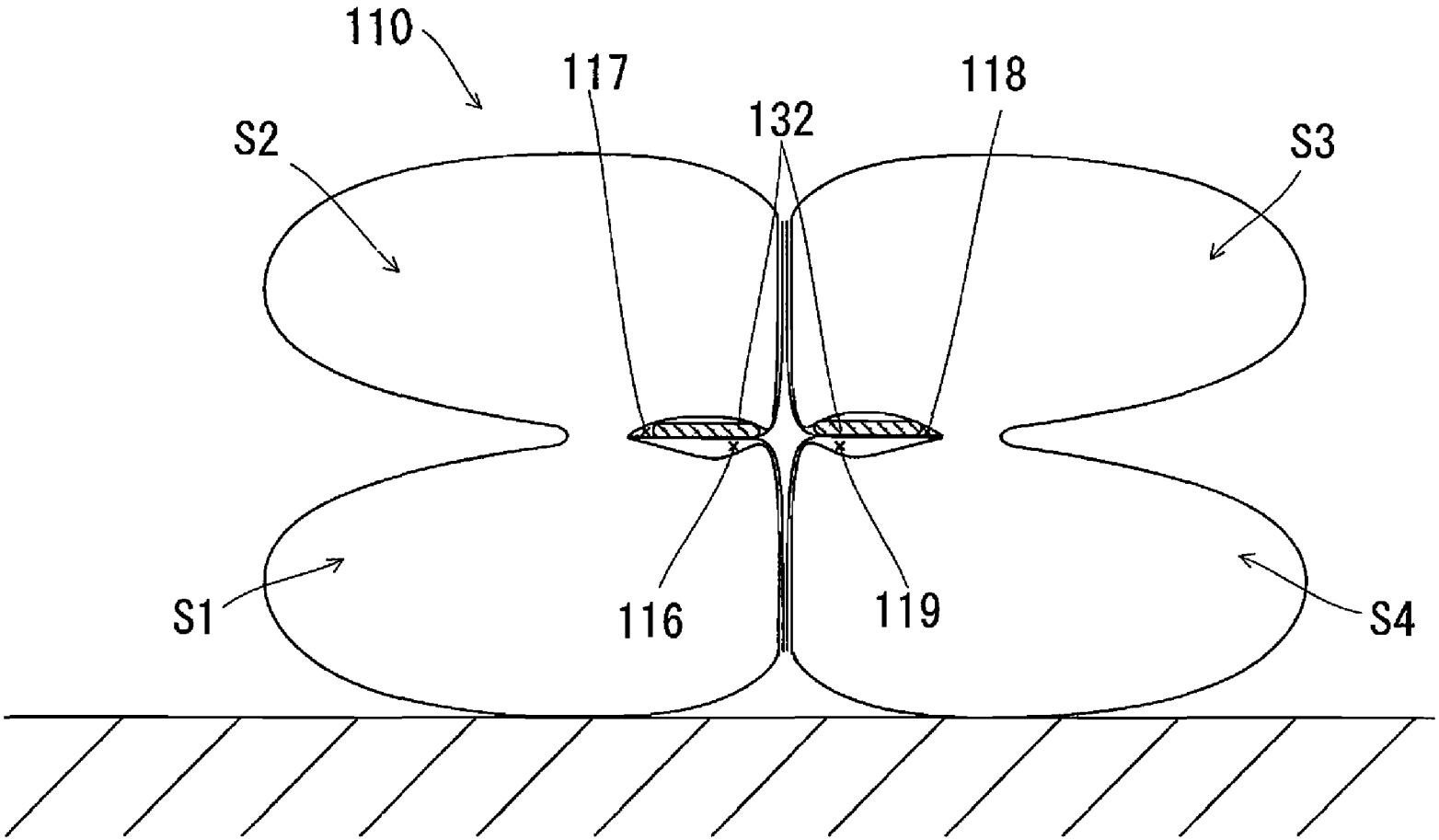
FIG. 7 is a schematic view showing the state in which the holding plates 132 are attached to the cleaning element 110 in this embodiment.

In the third manner shown in FIG. 7, the holding plates 132 are inserted into the insert regions 117, 118 of the cleaning element 110, so that the cleaning faces S2, S3 are placed on the upper face side of the cleaning element 110, while the cleaning faces S1, S4 are placed on the lower face side of the cleaning element 110.

Figure 8:
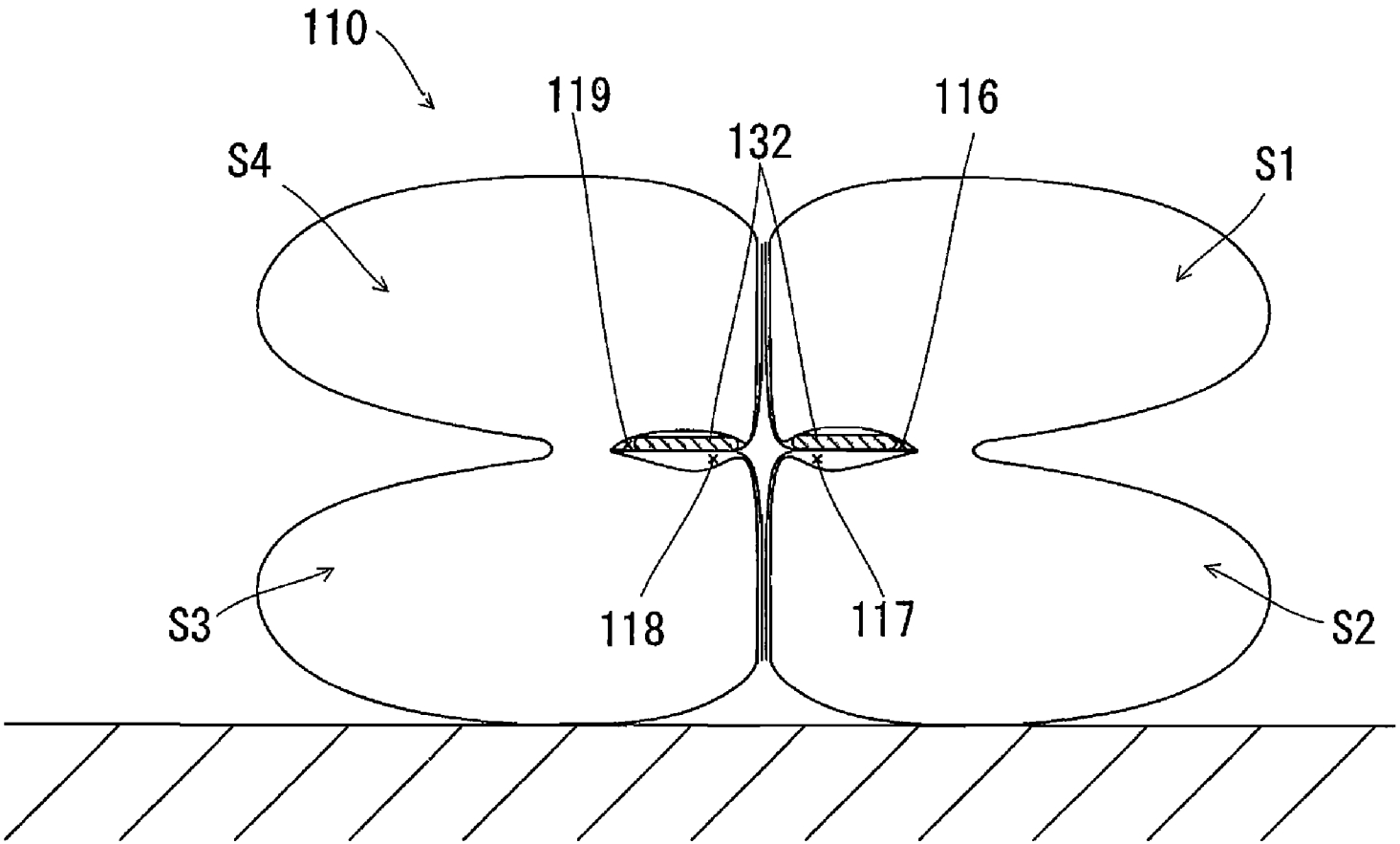
FIG. 8 is a schematic view showing the state in which the holding plates 132 are attached to the cleaning element 110 in this embodiment.

In the fourth manner shown in FIG. 8, the holding plates 132 are inserted into the insert regions 116, 119 of the cleaning element 110, so that the cleaning faces S1, S4 are placed on the upper face side of the cleaning element 110, while the cleaning faces S2, S3 are placed on the lower face side of the cleaning element 110.

Figure 9:
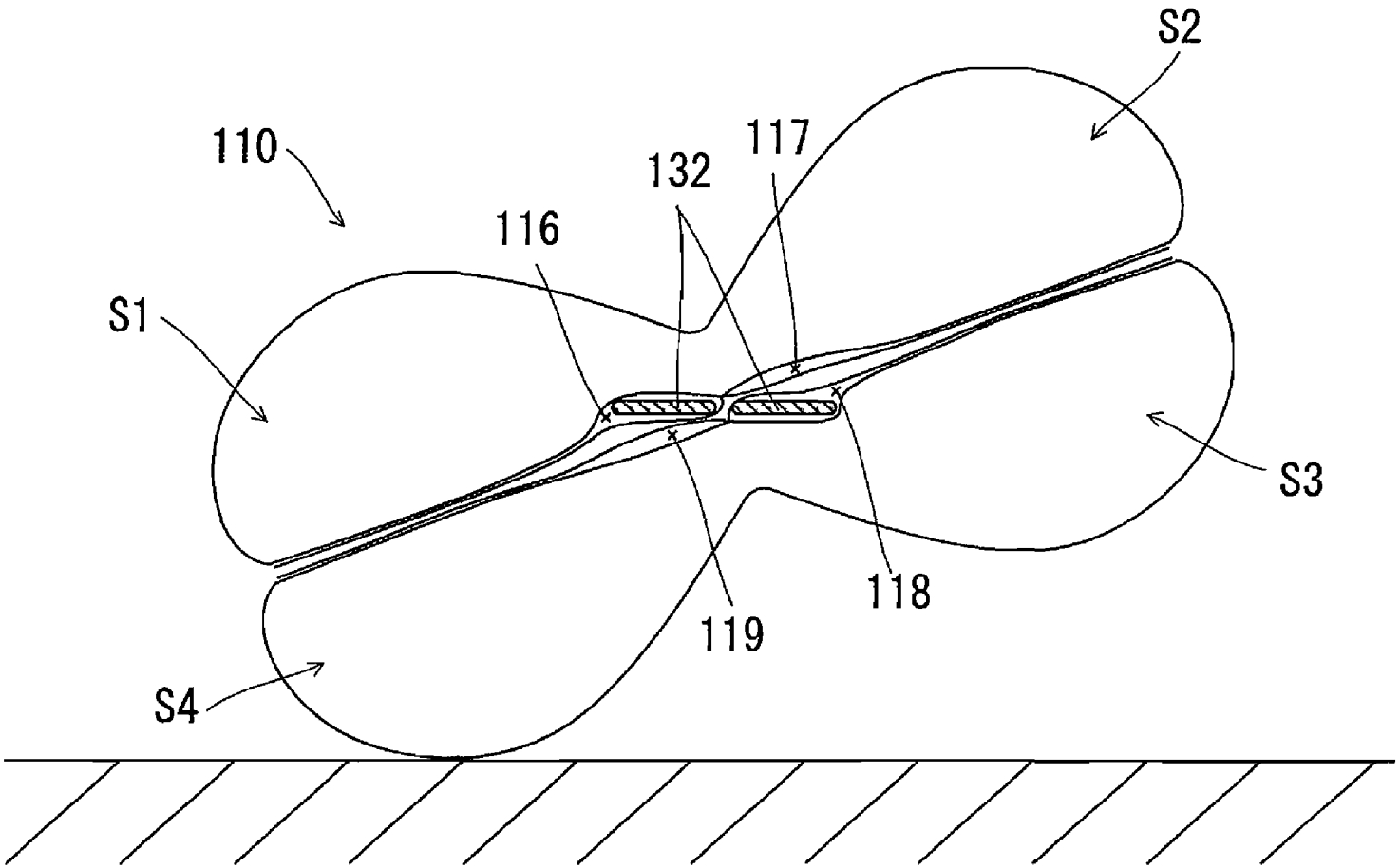
FIG. 9 is a schematic view showing the state in which the holding plates 132 are attached to the cleaning element 110 in this embodiment.

In the fifth manner shown in FIG. 9, the holding plates 132 are inserted into the insert regions 116, 118 of the cleaning element 110.

Figure 10:
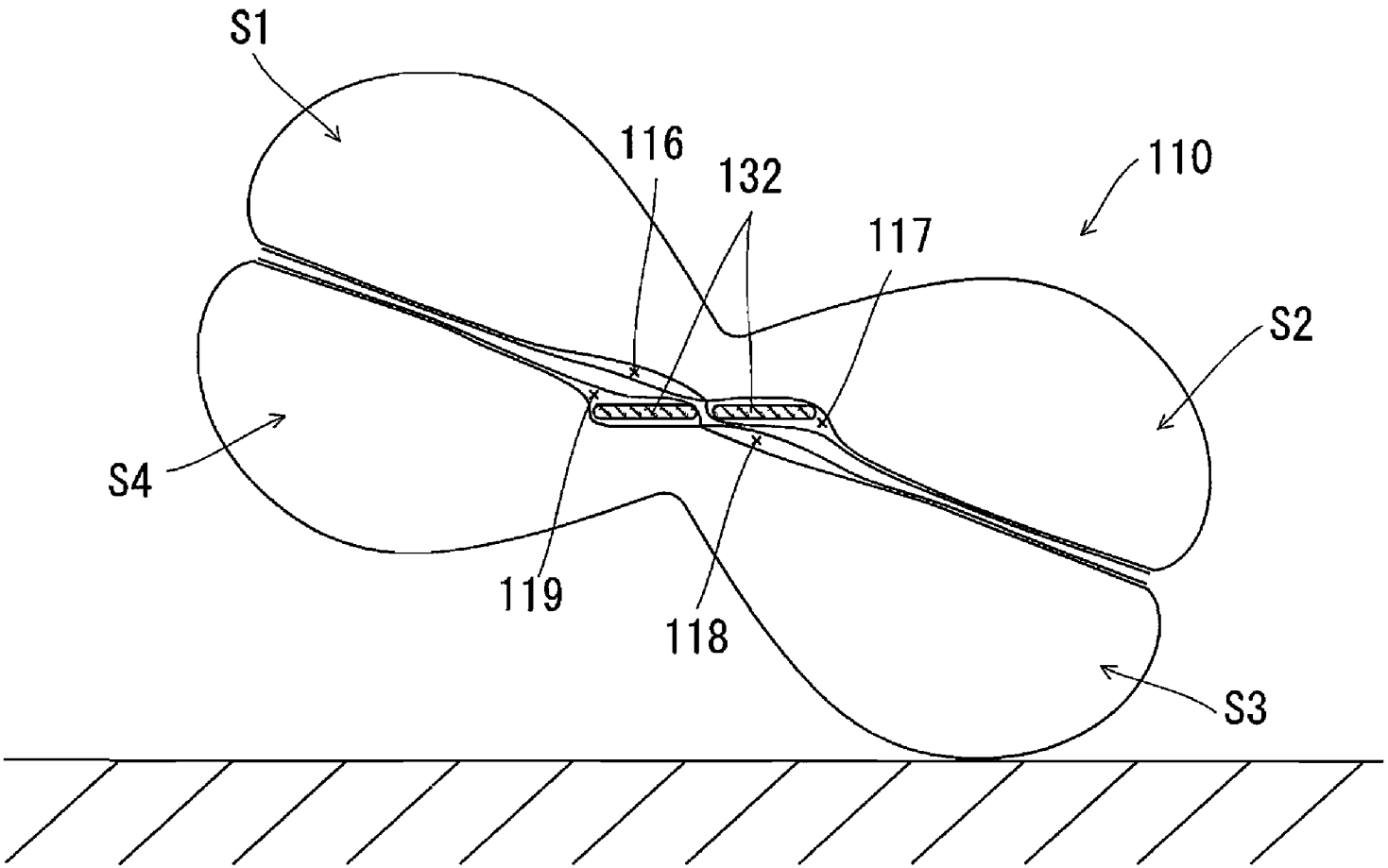
FIG. 10 is a schematic view showing the state in which the holding plates 132 are attached to the cleaning element 110 in this embodiment.

In the sixth manner shown in FIG. 10, the holding plates 132 are inserted into the insert regions 117, 119 of the cleaning element 110.

With such a construction, if contamination of the cleaning element 110 is found, the holding plates 132 can be reinserted in any other insertion manner. Thus, the entire outer surface of the cleaning element 110 can be evenly used as a cleaning face, so that the inherent cleaning ability of the cleaning element 110 can be fully utilized. Therefore, the cleaning effect can be enhanced. Further, one cleaning element 110 can be used for a longer period of time, so that it is more economical.

The present invention is not limited to the embodiment as described above, but rather, may be added to, changed, replaced with alternatives or otherwise modified. For example, the following provisions can be made in application of this embodiment.

In the above-described embodiment, the four insert regions 116, 117, 118, 119 into which the holding plates 132 can be inserted are provided inside the cleaning element 110, but in other embodiments, at least three insert regions can be provided inside the cleaning element 110.

Further, in the above embodiment, the cleaning element 110 has a layered structure having the two layered parts 110*a* overlaid one on the other. However, it is only necessary for the cleaning element of this invention to be configured such that the covering part forming the wiping face covers the at least three insert regions demarcated by the sheet element of nonwoven fabric. Therefore, the cleaning element may have a structure other than the above-described layered structure.

Further, in the above embodiment, the covering portion that covers the sheet element of nonwoven fabric is described as being formed by the fiber assembly, but in other embodiments the covering portion may be formed only by nonwoven fabric.

While the invention has been particularly shown and described with reference to preferred embodiments thereof, it will be understood by those skilled in the art that various changes in form and details may be made therein without departing from the spirit and scope of the invention.

I claim:

1. A cleaning element for wiping a region to be cleaned in combination with a cleaning element holder, said combination comprising:

an elongate cleaning element holder; and a cleaning element to be attached to the cleaning element holder, wherein:

the cleaning element holder includes a grip to be held by a user and two holding elements connected to the grip and extending parallel in a longitudinal direction with a predetermined spacing between the two holding elements, the cleaning element includes at least three insert regions demarcated by a sheet element of nonwoven fabric and extending parallel to each other and a covering part that forms a wiping face, and the two holding elements extending in parallel in the longitudinal direction with the predetermined spacing being inserted into two arbitrarily selected ones of the at least three insert regions.

2. The cleaning element for wiping a region to be cleaned in combination with a cleaning element holder as defined in claim 1, wherein:

the sheet element comprises a base sheet and a holding sheet which are formed of nonwoven fabric, the base sheet and the holding sheet being overlaid one on the other and bonded together in such a manner as to define the at least three insert regions, and the covering part includes:

the holding sheet positioned on the internal side of the cleaning element;

the base sheet positioned on the external side of the cleaning element; and a fiber assembly comprising a plurality of fibers extending in a predetermined direction, the fiber assembly being bonded to the base sheet in such a manner as to cover the base sheet.

3. A cleaning tool which comprises the cleaning element according to claim 1 and an elongate cleaning element holder, wherein the cleaning element holder includes two holding elements extending in parallel to one another with a predetermined spacing between the two holding elements, the two holding elements extending in parallel in the longitudinal direction with the predetermined spacing being inserted into two arbitrarily selected ones of the at least three insert regions of the cleaning element, and wherein the sheet element comprises a base sheet and a holding sheet which are formed of nonwoven fabric, the base sheet and the holding sheet being overlaid one on the other and bonded together in such a manner as to define the at least three insert regions, and the covering part includes:

the holding sheet positioned on the internal side of the cleaning element;

the base sheet positioned on the external side of the cleaning element; and a fiber assembly comprising a plurality of fibers extending in a predetermined direction, the fiber assembly being bonded to the base sheet in such a manner as to cover the base sheet.

* * * * *